US006854612B2

(12) United States Patent
Thomson

(10) Patent No.: US 6,854,612 B2
(45) Date of Patent: Feb. 15, 2005

(54) LIQUID CONTAINER CLOSURE ASSEMBLY

(75) Inventor: David William Thomson, Stirling (GB)

(73) Assignee: Daniel Montgomery & Son Limited, Glasgow (GB)

( * ) Notice: Subject to any disclaimer, the term of this patent is extended or adjusted under 35 U.S.C. 154(b) by 154 days.

(21) Appl. No.: 10/377,232

(22) Filed: Feb. 28, 2003

(65) Prior Publication Data

US 2003/0178442 A1 Sep. 25, 2003

Related U.S. Application Data

(63) Continuation of application No. PCT/GB00/04251, filed on Nov. 6, 2000.

(30) Foreign Application Priority Data

Aug. 31, 2000 (GB) ..... 0021246

(51) Int. Cl.[7] ..... B65D 39/00

(52) U.S. Cl. ..... 215/21; 215/230; 215/252; 222/153.06; 222/153.1; 222/541.5; 222/541.6; 222/547; 222/566

(58) Field of Search ..... 215/21, 251–253, 215/230, 258, 201, 203; 220/256.1, 257.1; 222/153.06, 153.09, 153.1, 541.6, 547, 566

(56) References Cited

U.S. PATENT DOCUMENTS 2,361,449 A * 10/1944 Benzinger ..... 215/246
4,458,817 A * 7/1984 Guala ..... 215/21
4,540,100 A * 9/1985 Willis ..... 215/252
5,246,124 A * 9/1993 Battegazzore ..... 215/251

* cited by examiner

*Primary Examiner*—Gene Mancene
*Assistant Examiner*—Patrick Buechner
(74) *Attorney, Agent, or Firm*—Notaro & Michalos P.C.

(57) ABSTRACT

The invention relates to a non-refillable tamper evident liquid container closure assembly which is applied to a mouth and neck portion of a container for liquid. The closure assembly provides a sleeve which is adapted to lie around the mouth and provided with three projection means projecting inwardly of the sleeve, the projection means are movable radially of the sleeve in a stiffly resilient manner and are engageable with an outer lip portion of the bottle neck. The assembly also includes a valve seat body which is receivable within the neck portion of the bottle, and is surrounded by the sleeve.

28 Claims, 7 Drawing Sheets

LIQUID CONTAINER CLOSURE ASSEMBLY

CROSS-REFERENCE TO RELATED APPLICATIONS

This application is a continuation of the US national phase designation of International application PCT/GB00/04251 filed Nov. 6, 2000, the content of which is expressly incorporated herein by reference thereto.

FIELD OF INVENTION

The present invention relates to a closure assembly adapted to be applied to a mouth of a container for liquid, for example, a neck of a bottle. The invention further relates to a tamper-evident device for a closure assembly adapted to be applied to a mouth of a container for liquid, for example, a neck of a bottle.

BACKGROUND OF INVENTION

For various reasons, it may be desirable to ensure that a used container, such as a bottle intended to contain spirits, is not re-filled with a replacement quantity of liquid, the characteristics and quality of which may differ from the original contents. Attempts to provide closures which make such re-filling difficult are not always proof against determined tampering. While it is considered advantageous to provide a tamper-indicating means which provides evidence that the bottle and its original contents are intact, if the bottle is resealed with a substitute cap or closure, there may be little to indicate to the purchaser that the bottle has been tampered with and that the contents may be inferior to the original contents.

It is, therefore, very important that an original closure cannot be removed without an extreme level of effort, or breakage being caused to the bottle.

It has, therefore, been found desirable to provide a closure means adapted to fit over and enclose a bottle neck portion, in which there is provided an arrangement of projections on the closure means that are caused to engage below a shoulder formed on a bottle neck. Such an arrangement is shown, for example, in GB Patent No. 2 274 837 also by the present Applicant, selected merely by way of illustration of a closure means including a tubular means provided with projections of the type referred to.

Due to the practical constraints of moulding techniques hitherto used to produce tubular means having inwardly and upwardly projections provided on inwardly facing surfaces thereof, there have been many attempts to facilitate both manufacture of tubular means and their application to bottle necks. For example, the projections have been moulded of resilient plastics material to facilitate their engagement with the shoulder. Alternatively, the projections may be hinged so as to enable efficient mould release. However, it will be appreciated that such resilient characteristics may be inconsistent with irremovable engagement with the shoulder.

Further, while it is very important that an original closure cannot be removed without visible damage or breakage being caused either to the closure or to the bottle, it has been found that a closure that cannot readily be removed will become the target of attempts to re-fill the container by overcoming any features provided in the closure intended to hinder or prevent this. Therefore in addition to providing devices to prevent re-filling of bottles, it has been found preferable to provide such devices with further tamper-indicating features which, while not acting in any preventative role, give a clear indication that a bottle has been opened since being originally filled with the genuine contents.

Furthermore, there is a need for simple designs of closure assemblies allowing easy and reliable manufacture, assembly and fitting to bottle necks. Such simplicity has been somewhat lacking in previous closure designs.

It is an object of at least one aspect of the present invention to obviate or mitigate at least one of the aforementioned problems/disadvantages in the prior art.

SUMMARY OF INVENTION

According to a first aspect of the present invention there is provided a closure assembly adapted to be applied to a mouth and neck portion of a container for liquid, the closure assembly comprising:

- a sleeve adapted to lie substantially concentrically with respect to the mouth and provided with means for fixing the sleeve on the container;
- a cap which is replacably removable; and
- an outer sleeve which is a substantially tight fit with the sleeve but rotatable with respect thereto;
- and wherein, in use, the outer sleeve remains on the sleeve when the cap is removed.

Preferably the fixing means comprises first means for fixing the sleeve on the container so as to restrain rotational movement of the sleeve with respect to the neck portion of the container.

Preferably also the fixing means comprises second means for fixing the sleeve on the container so as to restrict longitudinal movement of the sleeve with respect to the mouth of the container.

Preferably, the second means for fixing the sleeve are in the form of at least one projection means projecting inwardly of the sleeve, the at least one projection means being moveable radially of the sleeve in a stiffly resilient manner and being engageable with an outer lip portion of the container.

The closure assembly may further include valve means.

Preferably, the valve means comprise a valve seat body which is at least partially receivable within at least part of the mouth and neck portion of the container and wherein the valve seat body is at least partially surrounded by the sleeve.

Preferably, the valve means further comprises a moveable valve member.

Preferably the outer sleeve fits with the sleeve by means of an interference fit between an outer surface of the sleeve and an inner surface of the outer sleeve.

Preferably the cap comprises an inner cap and an outer cap.

Preferably the cap has thereon a threaded portion, which engages, with a corresponding threaded portion on the sleeve.

It is desired that the outer sleeve is aesthetically pleasing and as such it is preferred that the outer sleeve comprises metal foil.

Preferably the outer sleeve and the outer cap are made from metal foil.

Prior to initial opening the outer sleeve and outer cap may be attached by a frangible weakened circumferential portion, such that relative rotation of the outer sleeve and outer cap upon initial opening causes the portion to shear.

To enhance the aesthetic appeal, the outer sleeve may have printing formed thereon, for example, printed information such as words, designs, or logos or the like.

It is preferred that the sleeve and valve seat body are assembled together prior to application to the container.

Preferably the at least one projection means are provided on an inner wall of the sleeve to resiliently engage the neck portion of the container.

Preferably the sleeve contains one or more circumferential apertures around the sleeve, which are defined between axially extending portions of the sleeve.

The/each at least one projection means may be provided adjacent to an edge of one of the apertures.

It is preferred that each projection means is positioned on a lower circumferential edge of one of the apertures.

Conveniently the sleeve comprises a pouring outlet portion.

Typically the pouring outlet portion comprises a circumferentially extending pouring lip which desirably is positioned on or adjacent to an outer surface of the sleeve.

The sleeve may be further provided with a tubular body positioned inwardly and preferably concentrically of the pouring outlet portion and wherein the tubular body is attached to an inner surface of the sleeve via a plurality of webs.

Further, a bore of the tubular body may be closed, and in particular an outer face wall which closes the tubular body is preferred.

Alternatively the tubular body may be solid or a wall may be positioned at any convenient axial location along the body.

Preferably the closed wall of said tubular body is positioned to be flush with the circumferential pouring lip.

Conveniently said tubular body is provided with a circumferentially extending brim which is positioned on the lower outer edge of said body, and conveniently the webs connect an inner surface of the sleeve to the brim and the tubular body.

Conveniently each web is configured to provide a bracket upon which the brim fixedly sits.

The sleeve is further conveniently provided with a plurality of ribs or ridges formed on an inner surface thereof, preferably arranged circumferentially around the sleeve and having their long axes arranged substantially axially to said sleeve.

These ribs or ridges, in use, may co-act with raised pips, ridges or the like on an outer surface of the container to seek to prevent undesired rotational movement of the sleeve.

The valve seat body may comprise a tubular portion, a free end portion of which provides a valve seating surface adapted to be contacted in a sealing manner by a valve member captive in said tubular portion.

The valve seating surface is preferably a circumferentially extending flange, which extends radially inwardly of the tubular portion. In one embodiment such a valve seat is positioned at one end of the tubular portion and that end of the tubular portion is closed except for a circular aperture.

It will be understood that the tubular portion is adapted to be received within the mouth portion of the container.

The tubular portion further may comprise at least one engagement means on an outer surface thereof to engage an inner surface of the container in an interference fashion.

The engagement means are preferably radially extending circumferential ribs.

At or near to an end of the tubular portion distant from the valve seat is provided a substantially concentric tubular body of greater diameter than the tubular portion, and an inner surface of the tubular body is connected to an outer surface of the tubular portion with one or more further webs.

It is preferred that a first end of the tubular body is connected to an outer surface of the tubular portion by an annular flange.

Thus, in one embodiment of the present invention, such construction provides a circumferential trough defined between the outer wall of the tubular portion and the inner wall of the tubular body with the flange forming the trough floor. The trough is divided into smaller arc-shaped troughs by the further webs.

Such a trough helps prevent insertion of objects into the container through the closure assembly.

Preferably a second end of the tubular body is arranged to be substantially flush with an end of the tubular portion distant from the valve seat.

In use the tubular portion forms an inner sleeve of the assembled closure assembly.

Advantageously, an outer surface of the tubular body interference interacts with an inner surface of the sleeve.

Conveniently, a radially extending circumferential rim is located on an outer edge of an end of the tubular body which, in the assembled closure assembly is seated against a lower surface of a radially extending circumferential rim provided on an inner surface of the sleeve.

According to a second aspect of the present invention there is provided a container including a closure assembly according to the first aspect of the present invention.

BRIEF DESCRIPTION OF DRAWINGS

An embodiment of the present invention will now be described by way of example only, and with reference to the accompanying drawings, which are.

DETAILED DESCRIPTION OF DRAWINGS

Figure 1:
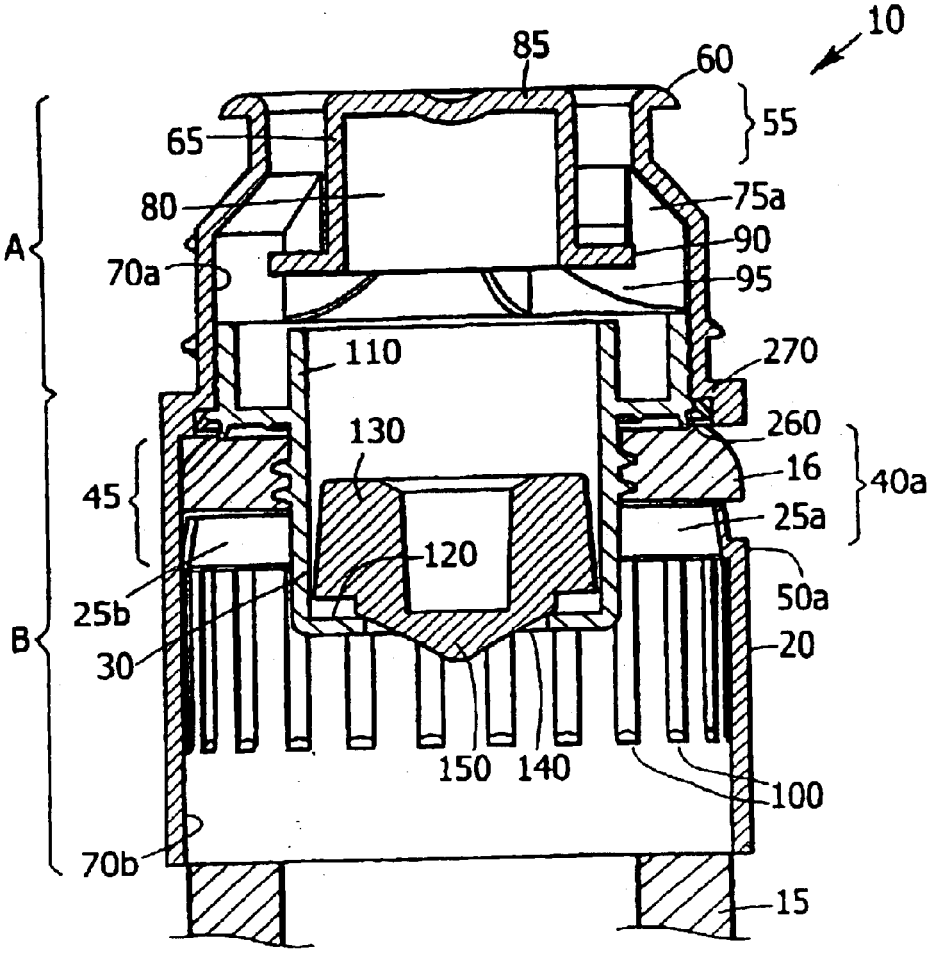
FIG. 1 a longitudinal cross-sectional view of part of a closure assembly according to an embodiment of the present invention in combination with a neck of a bottle.

Referring initially to FIG. 1, there is shown a portion of a closure assembly, generally designated 10, according to an embodiment of the present invention which is applied to a mouth and neck portion 15 of a container for liquid which in this embodiment is a bottle neck.

The closure assembly provides a sleeve 20 which is adapted to lie around the mouth 15 and provided in this embodiment with three projection means 25*a*, 25*b* and 25*c* (25*a* and 25*b* only are visible) projecting inwardly of the sleeve 20. The projection means 25*a*, 25*b*, 25*c*, are movable radially of the sleeve 20 in a stiffly resilient manner and are engagable with an outer lip portion which in this embodiment is shown as shoulder 16, of the bottle neck 15.

The sleeve 20 has a first portion A and a second portion B which are integrally joined. Portion A has a smaller diameter than portion B, and sits above portion B.

There is also shown a valve seat body 30 which is receivable within the neck portion 15 of the bottle, and as shown the valve seat body 30 is surrounded by the sleeve 20.

The projection means 25*a*, 25*b* and 25*c* are provided on an inner surface 70*b* of portion B of the sleeve 20 to resiliently engage the shoulder 16 which is part of the neck portion 15 of the bottle. The projection means 25*a*, 25*b*, 25*c*, are formed in the position they adopt once engaged with the bottle neck 15 and are formed, in this embodiment, from a stiffly resilient plastic material such as that obtainable under the trade name STYROLUX.

Three circumferential apertures 40*a*, 40*b* and 40*c* (40*a* only is labelled) are spaced substantially equally around the sleeve 20 which are defined between axially extending portions 45 of the sleeve 20. Each of the projection means 25*a*, 25*b* and 25*c* is positioned on a lower circumferential edge 50*a*, 50*b* or 50*c* respectively (50*b* and 50*c* not shown) of the respective apertures 40*a*, 40*b* or 40*c*.

Portion A of the sleeve 20 has a pouring outlet portion generally designated 55. The pouring outlet portion 55 comprises a circumferentially extending pouring lip 60 which is positioned on an outer surface of the sleeve 20.

The sleeve 20 is also provided with a tubular body 65 which is positioned inwardly and concentrically of the pouring outlet portion 55. In this embodiment the tubular body 65 is attached to an inner surface 70*a* of portion A of sleeve 20 via six webs 75*a*–75*f* (75*a* only is labelled). Further, the bore 80 of the tubular body 65 is closed by an outer face wall 85.

In two modifications of the present embodiment (not shown), the tubular body 65 may be a solid body or the wall 85 may be positioned at any convenient axial location along body 65. However, in this embodiment the closed wall 85 of tubular body 65 is positioned to be substantially flush with the circumferential pouring lip 60.

The tubular body 65 is provided with a circumferentially extending brim 90 which is positioned on a lower outer edge of body 65, and conveniently the webs 75*a*–75*f* connect the inner surface 70*a* of portion A of sleeve 20 to the brim 90 and also to the tubular body 65. The webs are configured to provide a bracket means 95 upon which the brim 90 fixedly sits.

Portion B of sleeve 20 is further provided with a plurality, eg twenty four ribs 100 formed on the inner surface 70*b* which are arranged circumferentially around sleeve 20, and having their long axes arranged axially to sleeve 20.

These ribs 100, in use when the closure assembly 10 is applied to a bottle neck, co-act with raised ridges (not shown) on the outer surface of the bottle neck 15 to help prevent undesired rotational movement of the sleeve 20. Some minor rotation in either a clockwise or anticlockwise direction may occur until a stop position is found by a rib or ribs 100 acting against a raised ridge or ridges.

The valve seat body 30 is shaped as a tubular portion 110, an end portion of which provides a valve seating surface 120 which is sealed by the valve member 130 captive in the tubular portion 110.

The valve seating surface 120 is in the form of a circumferentially extending flange, which extends radially inwardly of the tubular portion 110. In this embodiment the valve seat 120 is positioned at one end of the tubular portion 110 and that end of the tubular portion 110 is closed by the valve seat 120 except for a circular aperture 140 which receives a tapered end 150 of the valve member 130.

Figure 2:
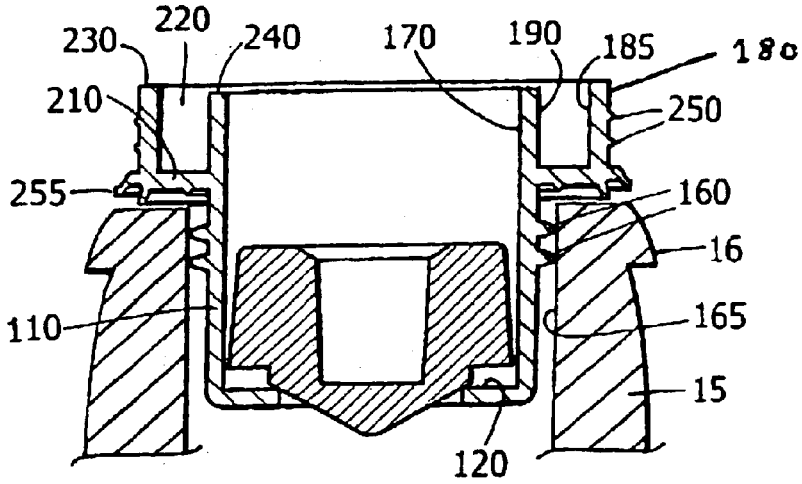
FIG. 2 a longitudinal cross-sectional view of a valve seat body and valve member of the closure assembly of FIG. 1 in combination with a neck of a bottle.

The tubular portion 110 is adapted to be received within the mouth portion 15 of the bottle which is shown more clearly in FIG. 2. In FIG. 2, it can be seen that the tubular portion 110 has engagement means 160 which in this embodiment are two radially extending circumferential ribs on an outer surface of the tubular portion 110 which engage an inner surface 165 of the bottle neck 15 in an interference fashion so that the ribs deform slightly to fit tightly against the inner surface 165.

Figure 5:
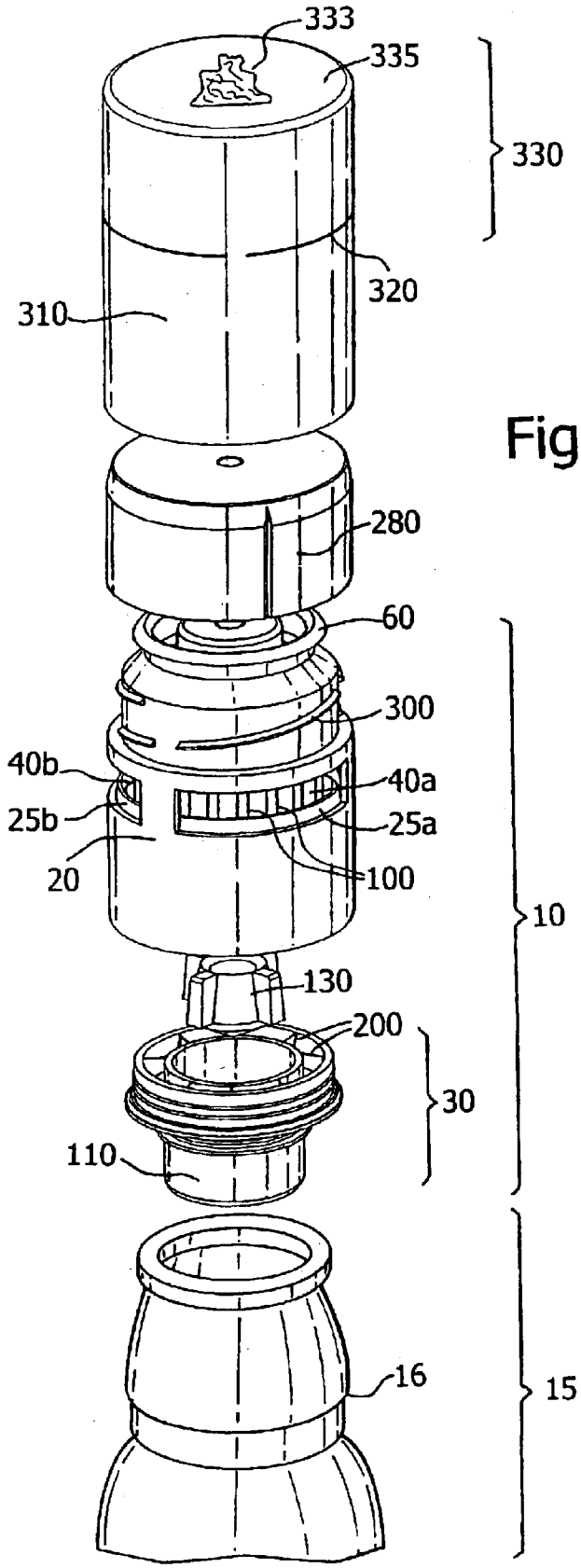
FIG. 5 an exploded perspective view of the closure assembly of FIG. 1 with a cap and in combination with cap and bottle neck.

End 170 of the tubular portion 110 which is distant from the valve seat 120 end is surrounded by a concentric tubular body 180 of greater diameter than the tubular portion 110, and an inner surface 185 of the tubular body 180 is connected to an outer surface 190 of tubular portion 110 with a plurality of, eg eight, further webs 200 (see perspective view of valve seat body 30 in FIG. 5). The tubular body 180 is further connected to the outer surface 190 of the tubular portion 110 by an annular flange 210.

Thus, in this embodiment of the present invention, such construction provides a circumferential trough 220 defined between the outer wall 190 of the tubular portion 110 and the inner wall 185 of the tubular body 180 with the flange 210 forming the trough floor. The trough 220 is divided into eight smaller arc-shaped troughs by the eight further webs 200.

Such a trough 220 helps prevent unauthorised insertion of objects, for example, liquid filling means, such as a tube, into the bottle through the closure assembly 10, and mouth of the bottle. The trough does not however significantly, if at all, hinder the outflow of liquid from the bottle when poured.

As can be seen from FIG. 2, the upper end 230 of the tubular body 180 is arranged to be slightly raised compared to the upper end 240 of the tubular portion 110. In use the tubular portion 110 forms an inner sleeve of the assembled closure assembly 10.

Advantageously, the tubular body 180 outer surface is shaped to have two radially extending circumferential ribs 250 which interference interact with the inner surface 70*a* of portion A of the sleeve 20 so that the valve seat body 30 fits tightly within the sleeve 20.

A lower outer surface of tubular body 180 extends as a circumferential rim 255 which, in the assembled closure assembly 10 is seated against a lower surface 260 of a radially extending circumferential shoulder 270 formed at a juncture between portions A and B of sleeve 20 (see FIG. 1) thus providing a stop position which prevents further upward insertion of the valve seat body 30 into the sleeve 20.

Figure 3:
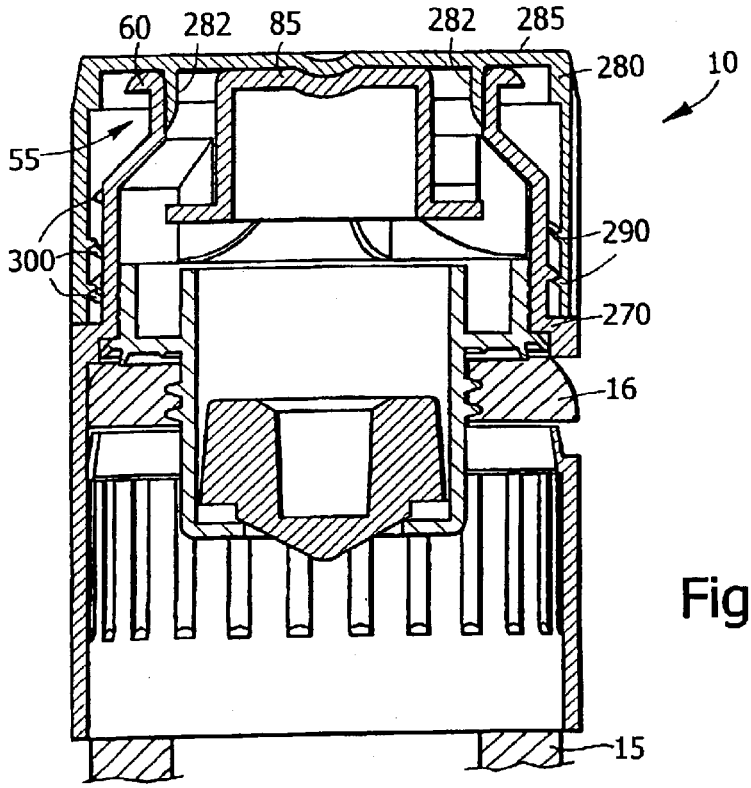
FIG. 3 a longitudinal cross-sectional view of the closure assembly of FIG. 1 further including a cap.

Referring now to FIG. 3, there is shown a complete closure assembly 10 according to the disclosed embodiment of the present invention including a closure cap 280 fitted to the assembly 10.

The cap 280 has a closed end 285 and a thread portion 290 which engages with a corresponding thread portion 300 positioned on the outer surface of portion A of sleeve 20.

The closed end 285 seals against the pouring lip 60 and outer face wall 85, and an inner tubular portion 282 which is fixed to the closed end 285 of cap 280 engages intimately within the pouring outlet portion 55 to form a further seal. The cap 280 sits on top of shoulder 270 formed at the juncture between portions A and B of sleeve 20 which assists in preventing over downward movement of the cap 280, to give a tight fit. The cap 280 has a diameter such that, once fitted, it sits so that the sides are substantially flush to the sides of portion B of sleeve 20. This is important because the flush fit allows an outer sleeve 310 and outer cap 330 of constant diameter to be placed over both cap 280 and sleeve 20, which is described hereinbelow with reference to FIG. 4.

Figure 4:
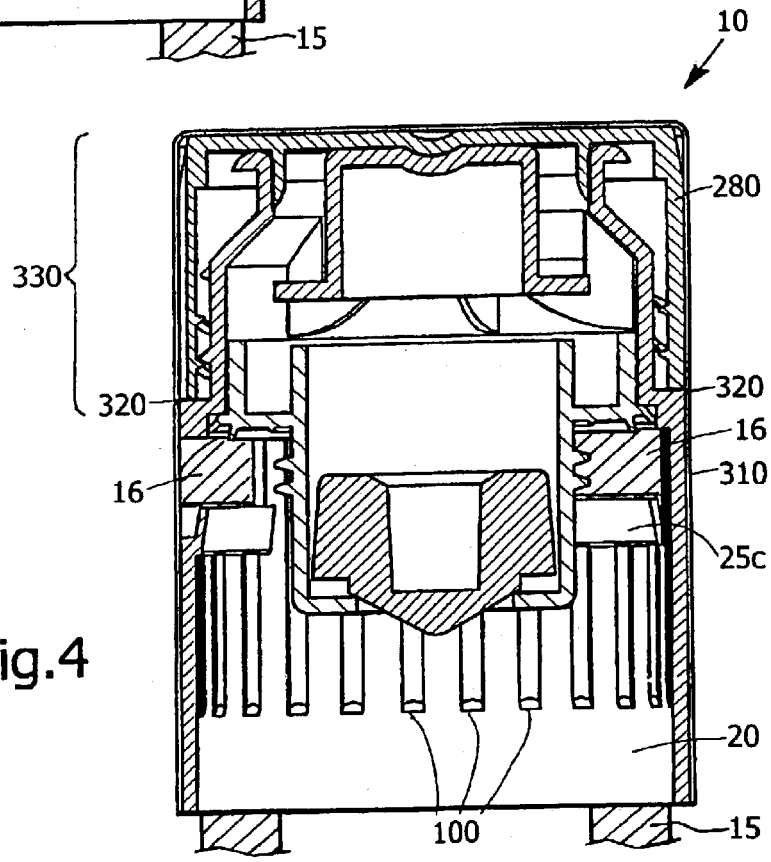
FIG. 4 a longitudinal cross-sectional view of the closure assembly of FIG. 1 with a cap and further including an outer sleeve.

FIG. 4 shows the closure assembly 10, wherein is shown the cap 280, outer cap 330, and outer sleeve 310.

Figure 8:
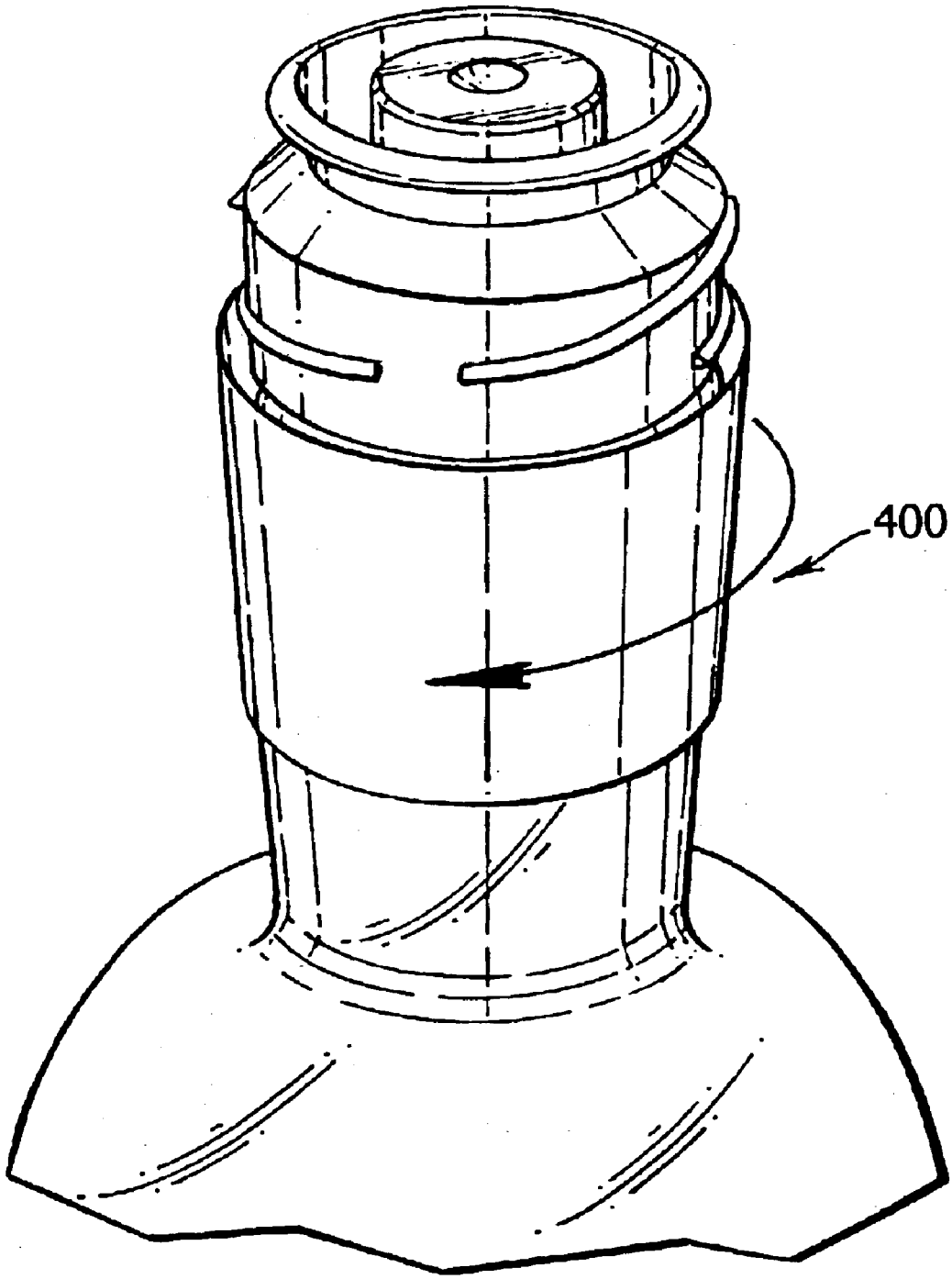
FIG. 8 a perspective view of the closure assembly of FIG. 1 including an outer sleeve in combination with the bottle neck.

The closure assembly 10 is applied to the mouth and neck portion 15 of a container for liquid which in this embodiment is a bottle. The sleeve 20 is adapted to lie concentrically with respect to the bottle mouth 15 and is provided with means for fixing the sleeve 20 on the bottle. In this embodiment the fixing means are in the form of the projection means 25*a*, 25*b*, 25*c*. The projection means 25*a*, 25*b*, 25*c* fix the sleeve 20 on the bottle to restrict longitudinal movement of the sleeve 20 relative to the bottle by sitting underneath the bottle shoulder 16. Restraining means 100 are provided for restraining rotational movement of the sleeve 20 by engagement with raised ridges (not shown) on the outer surface on the bottle mouth 15. The outer sleeve 310 surrounds portion B of the sleeve 20 in a tight interference fit. Full, 360° rotation of the outer sleeve 310 with respect to the sleeve 20 is however permitted as indicated by arrow 400 in FIG. 8.

The outer sleeve 310 fits by means of an interference between an outer surface of the sleeve 20 and an inner surface of the outer sleeve 310.

The outer cap 330 is associated with the cap 280 by means of a tight interference fit. The outer cap 330 is associated with outer sleeve 310 by means of a frangible portion 320 which connects the outer cap 330 with outer sleeve 310. This means that when the cap 280 is twisted by a user gripping the outer cap 330 in a bottle opening operation, the frangible portion 320 fails or breaks, to release the outer cap 330 from the outer sleeve 310 enabling the cap 280 to be removed from portion A of sleeve 20, and leaving the outer sleeve 310 covering portion B of sleeve 20. This breaking of the frangible portion indicates to subsequent users that the bottle has already been opened; thus the combination of outer sleeve 310 with outer cap 330 is a tamper evident device.

It is desired that the closure assembly 10 is aesthetically pleasing and as such the outer sleeve 310 and outer cap 330 are made from metal foil such as aluminium or any other formable material. The metal foil or formable material is relatively thick such that it is self-supporting when not in association with the cap 280 or sleeve 20 and cannot be easily torn or ripped although it may be deformable.

To enhance the aesthetic appeal, the outer sleeve 310 and/or outer cap 330 may be coloured and/or have printing formed thereon, for example, printed information such as words, designs, or logos, such as logo 333 provided on an outer surface of a closed wall 335 of outer cap 330 as indicated in FIG. 5.

Referring now to FIG. 5, there is shown an exploded perspective view of closure assembly 10 with cap 280, and outer cap 330 which is attached to outer sleeve 310, and bottle neck portion 15.

The closure assembly 10 consists of sleeve 20 having apertures 40*a*, 40*b* and 40*c* (40*c* not shown) with projection means 25*a*, 25*b* and 26*c* (25*c* not shown) located on the lower edges of the apertures 40*a*, 40*b* and 40*c* respectively. The sleeve 20 further has a pouring lip 60, inner surface ribs 100 and a thread portion 300. Valve seat body 30 and valve member 130 are also shown.

The outer cap 330 and outer sleeve 310 are attached by frangible portion 320, which allows the outer cap 330, which corresponds to the height of the cap 280 to be removed with the cap 280 when it is twisted away from the sleeve 20 by a user in an opening operation.

The closure assembly 10 may be conveniently assembled and optionally the cap 280, outer cap 330 and outer sleeve 310 also assembled to give a single unit ready for simple application to a bottle neck thus enhancing the efficiency of the manufacture and assembly process.

Typically, the bottle is made from glass or alternatively a plastics material, the outer cap 330 and outer sleeve 310 from aluminium, the cap 280 from low density polyethylene, the sleeve 20 from a stiffly resilient plastics material such as polypropylene or polystyrene and which in this embodiment is a polystyrene obtainable under the trade name, STYROLUX, the valve member 130 from crystal polystyrene and the valve seat body 30 from low density polyethylene.

Figure 9:
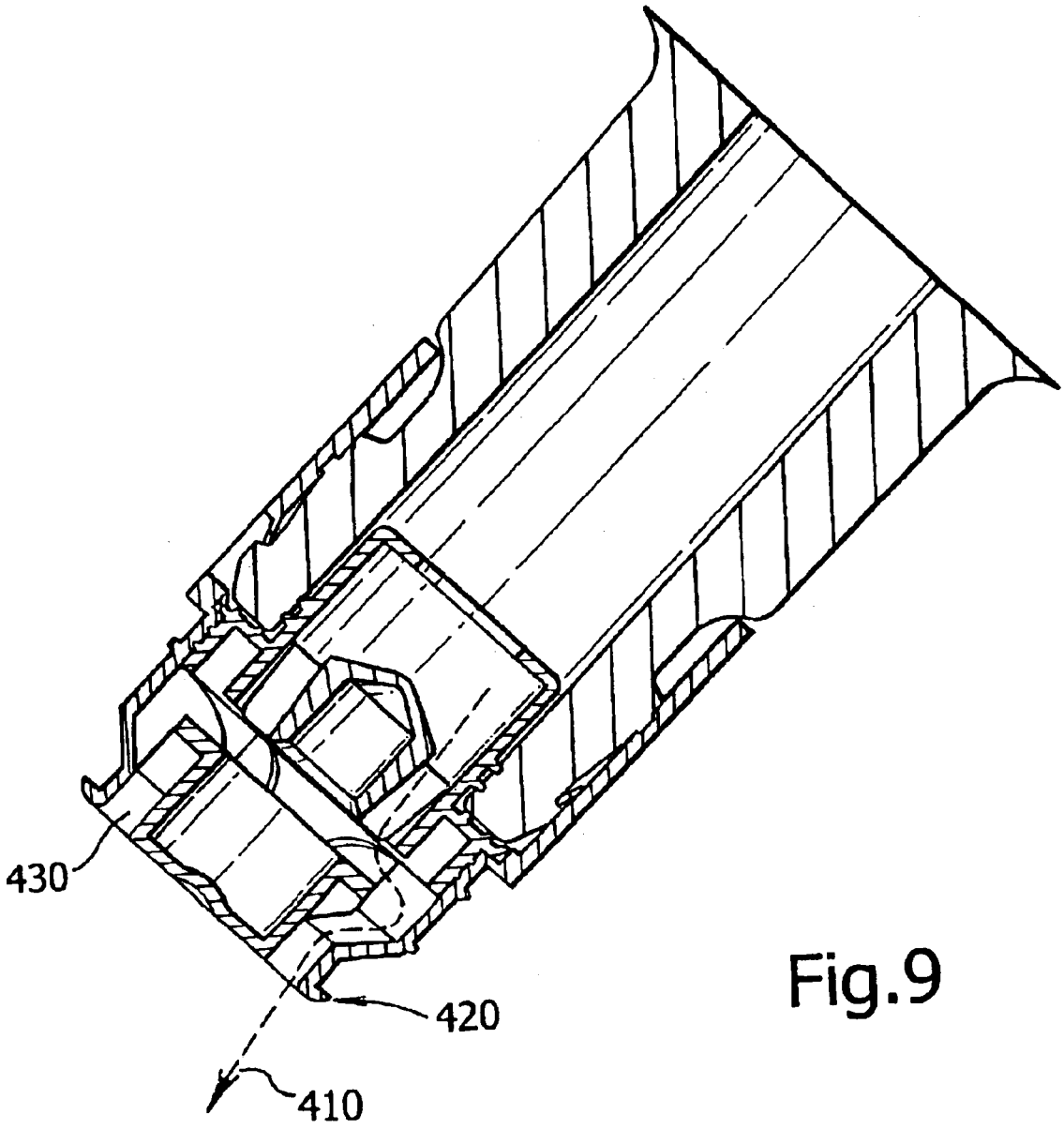
FIG. 9 a longitudinal cross-sectional view of the closure assembly and bottle neck of FIG. 8 in a pouring orientation.

Once such an assembly 10 has been fitted on to a bottle neck 15, a contorted path for liquid flow is formed within the assembly 10 as indicated by dotted arrow 410 in FIG. 9. When the bottle is tipped into a pouring position as shown, the valve member 130 falls forwards to a stop position provided by brim 90 and webs 75*a*–75*f*, to create the liquid flow path. A sharp edge 420 is provided on lip 60 to allow a clean cut-off of liquid to reduce drips. This contorted path in combination with the non-return valve (formed from the valve seat body 30 and valve member 130) which is closed in a normally upright position of the bottle, and air intake 430, while allowing liquid to flow from the bottle in a pouring operation, restricts in-flow of liquid into the bottle by simple unauthorised filling operations or even more sophisticated methods which may involve insertion of objects, tubes etc into the bottle mouth.

Figure 7:
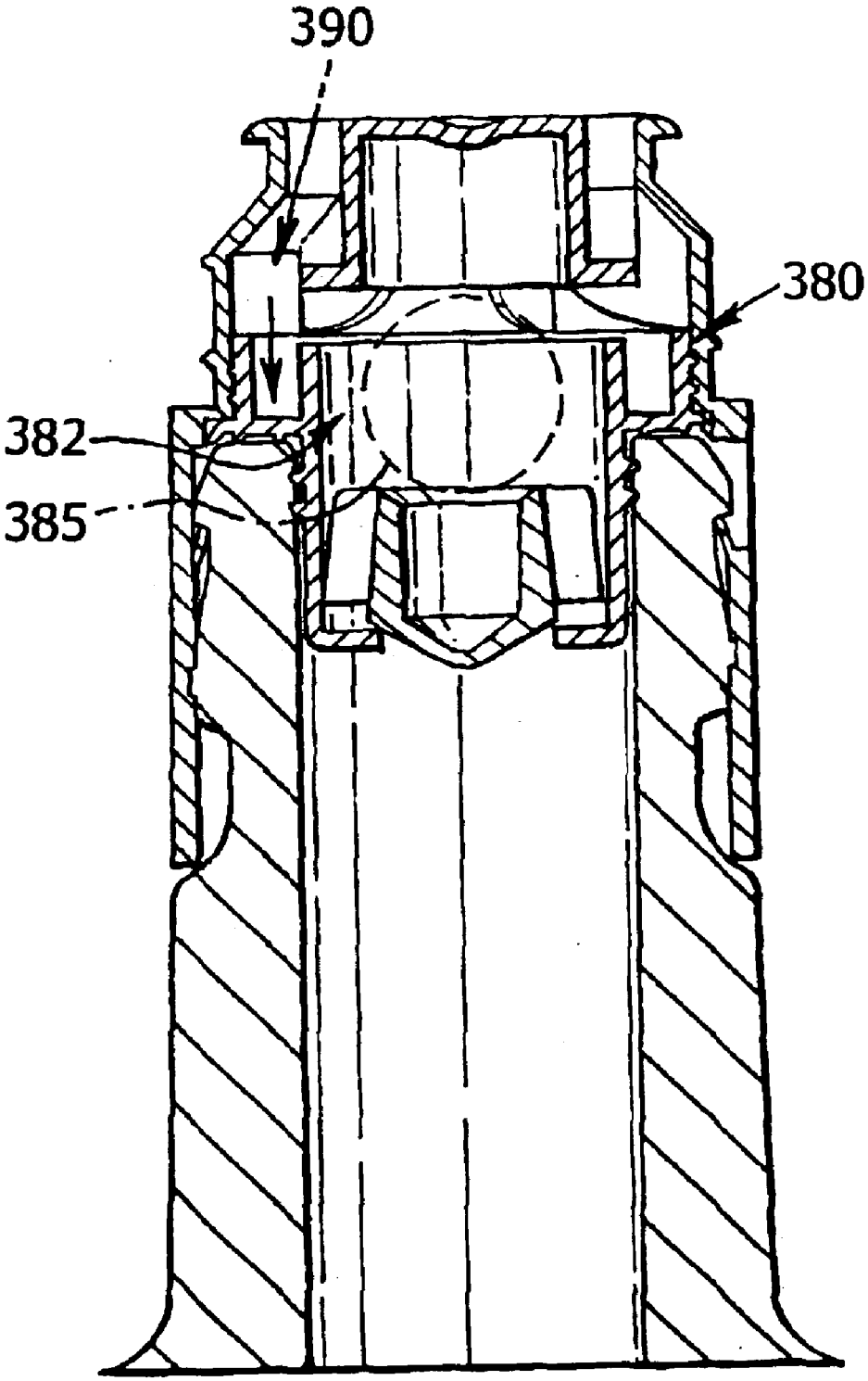
FIG. 7 a longitudinal cross-sectional view of the closure assembly of FIG. 1 and bottle neck.

As an additional safety measure from insertion of objects, eg a hot wire, a glass ball 385, as shown in FIG. 7, indicated by a dotted line may be provided which sits above valve member 130 within a chamber 382 of valve seat body 30. FIG. 7 also clearly shows the double wall construction 380 of valve seat body 30 forming trough 220 to help prevent insertion of objects, eg filling tubes or other flexible objects or instruments into the bottle. Valve chamber 382 can only be accessed at an angle indicated by arrow 380 in FIG. 7 which leads to a stop position at flange 210 which forms the floor of trough 220. The only means of access to the valve seat chamber 382 within valve seat body 30 is with a 90° turn followed by another 90° turn vertically.

Figure 6:
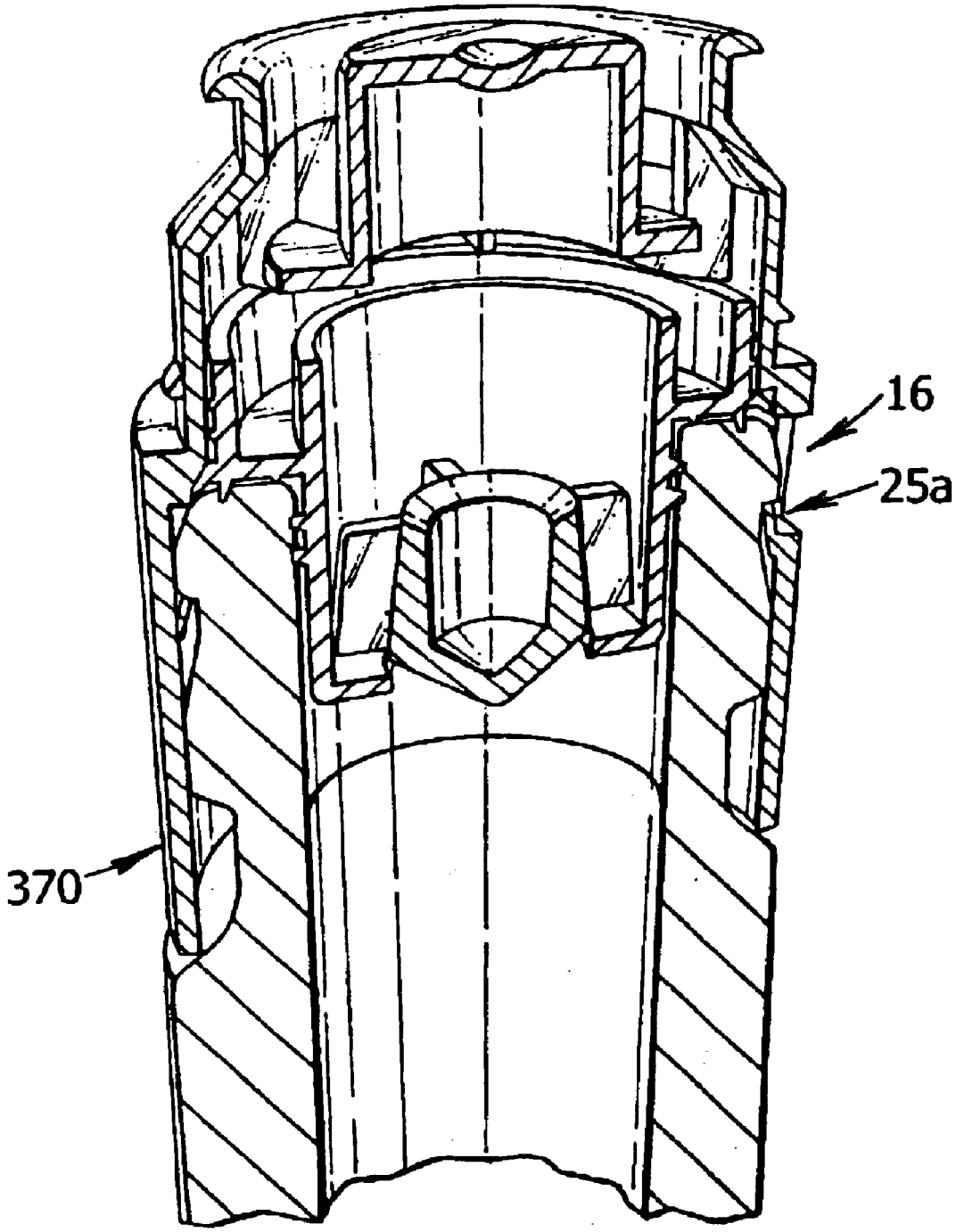
FIG. 6 a longitudinal perspective cross-sectional view of the closure assembly of FIG. 1 and bottle neck.

Attempted removal of the assembly 10 is also resisted because of the locking of the projection means 25 underneath the bottle shoulder 16 as shown in FIG. 6, and restricted rotation of assembly 10 provided by ribs 100, the position of which is indicated by arrow 370 in FIG. 6. Furthermore, sufficient grip to twist the assembly 10 is difficult to obtain because the outer sleeve 310 rotates about the assembly 10 thus resisting any movement or weakening of the assembly 10. This is important because removal of such assemblies is commonly attempted by heating the assembly to soften the material from which it is made, and twisting it with respect to the bottle neck 15 until the anti-rotation ribs, eg ribs 100 and locking means, eg. projection means 25*a*, 25*b* and 25*c* weaken to allow the assembly 10 to be removed from the bottle. Such twisting may be substantially prevented by provision of outer sleeve 310 thus preventing removal of the assembly 10.

It shall be appreciated that the embodiment of the present invention hereinbefore described is given by way of example only, and is not meant to limit the scope of the invention in any way. Particularly, it should be understood that various modifications may be made within the scope of the invention. For example, the outer sleeve 310 may comprise materials other than metal such as plastics materials.

What is claimed is:

1. A closure assembly adapted to be applied to a mouth and neck portion of a container for liquid, the closure assembly comprising:

a sleeve adapted to lie substantially concentrically with respect to the mouth and provided with means for fixing the sleeve on the container;

a cap which is replacably removable; and an outer sleeve which is a substantially tight fit with the sleeve but rotatable with respect thereto, and wherein, in use, the outer sleeve remains on the sleeve when the cap is removed.

2. A closure assembly according to claim 1, wherein the fixing means comprises first means for fixing the sleeve on the container so as to restrain rotational movement of the sleeve with respect to a neck portion of the container, and the fixing means comprises second means for fixing the sleeve on the container so as to restrict longitudinal movement of the sleeve with respect to the mouth of the container.

3. A closure assembly according to claim 2, wherein the second means for fixing the sleeve are in the form of at least one projection means projecting inwardly of the sleeve, the at least one projection means being moveable radially of the sleeve in a stiffly resilient manner and being engageable with an outer lip of the container.

4. A closure assembly according to claim 1, further including valve means.

5. A closure assembly according to claim 4, wherein the valve means comprises a valve seat body which is at least partially receivable within at least part of the mouth and neck portion of the container and wherein the valve seat body is at least partially surrounded by the sleeve, and the valve means further comprises a moveable valve member.

6. A closure assembly according to claim 1, wherein the outer sleeve fits with the sleeve by means of an interference fit between an outer surface of the sleeve and an inner surface of the outer sleeve.

7. A closure assembly according to claim 1, wherein the cap comprises an inner cap and an outer cap.

8. A closure assembly according to claim 1, wherein the cap has thereon a threaded portion which engages with a corresponding threaded portion on the sleeve.

9. A closure assembly according to claim 7, wherein prior to initial opening the outer sleeve and outer cap are attached by a frangible portion, such that relative rotation of the outer sleeve and outer cap upon initial opening causes the portion to shear.

10. A closure assembly according to claim 7, wherein the outer sleeve and outer cap are made from metal foil.

11. A closure assembly according to claim 5, wherein the sleeve and valve seat body are assembled together prior to application to the container.

12. A closure assembly according to claim 3, wherein the at least one projection means are provided on an inner wall of the sleeve to resiliently engage a lip portion of the container.

13. A closure assembly according to claim 12, wherein the sleeve contains one or more circumferential apertures around the sleeve which are defined between axially extending portions of the sleeve.

14. A closure assembly according to claim 13, wherein the at least one projection means is provided adjacent to an edge of one of the apertures.

15. A closure assembly according to claim 14, wherein each projection means is positioned on a lower circumferential edge of one of the apertures.

16. A closure assembly according to claim 1, wherein the sleeve comprises a pouring outlet portion.

17. A closure assembly according to claim 16, wherein the pouring outlet portion comprises a circumferentially extending pouring lip which is positioned on or adjacent to an outer surface of the sleeve.

18. A closure assembly according to claim 17, wherein the sleeve is provided with a tubular body, a bore of which is closed by an outer face wall which is positioned to be flush with the circumferential pouring lip positioned inwardly and concentrically of the pouring outlet portion, and wherein the tubular body is attached to an inner surface of the sleeve via a plurality of webs.

19. A closure assembly according to claim 18, wherein the tubular body is provided with a circumferentially extending brim which is positioned on the lower outer edge of said body, and wherein each of the webs connect an inner surface of said sleeve to the brim and the tubular body by providing a bracket upon which the brim fixedly sits.

20. A closure assembly according to claim 1, wherein the sleeve is provided with a plurality of ribs or ridges formed on an inner surface thereof, arranged circumferentially around the sleeve and having their long axes arranged substantially axially to the sleeve.

21. A closure assembly according to claim 20, wherein, in use, the ribs or ridges co-act with raised pips or ridges on an outer surface of the container to act to prevent undesired rotational movement of the sleeve.

22. A closure assembly according to claim 5, wherein the valve seat body comprises a tubular portion, a free end portion of which provides a valve seating surface adapted to be contacted in a sealing manner by a valve member captive in the tubular portion, and wherein the valve seating surface is a circumferentially extending flange which extends radially inwardly of the tubular portion and the valve seating surface is positioned at one end of the tubular portion and that end of the tubular portion is closed except for a circular aperture.

23. A closure assembly according to claim 22, wherein the tubular portion is adapted to be received within a mouth portion of the container.

24. A closure assembly according to claim 22, wherein the tubular portion comprises at least one engagement means on an outer surface thereof to engage an inner surface of the container in an interference fashion, the engagement means being radially extending circumferential ribs.

25. A closure assembly according to claim 22, wherein there is provided at or near to an end of the tubular portion distant from the valve seat a substantially concentric tubular body of greater diameter than the tubular portion, and wherein an inner surface of the tubular body is connected to an outer surface of the tubular portion with one or more further webs, and a first end of the tubular body is connected to an outer surface of the tubular portion by an annular flange to provide a circumferential trough defined between the outer wall of the tubular portion and the inner wall of the tubular body with the flange forming the trough floor, and the trough is divided into arc-shaped troughs by the further webs.

26. A closure assembly according to claim 25, wherein the outer surface of the tubular body interference interacts with an inner surface of the sleeve, and wherein a radially extending circumferential rim is located on an outer edge of an end of the tubular body which, in the assembled closure assembly, is seated against a lower surface of a radially extending circumferential rim provided on an inner surface of the sleeve.

27. A container including a closure assembly according to claim 1.

28. A container as claimed in claim 27, wherein the container is a bottle.

* * * * *